US008166697B1

(12) United States Patent
Sueskind

(10) Patent No.: US 8,166,697 B1
(45) Date of Patent: May 1, 2012

(54) RIFLE SCOPE INDICIA SYSTEM

(76) Inventor: Alan E. Sueskind, Westbury, NY (US)

( * ) Notice: Subject to any disclaimer, the term of this patent is extended or adjusted under 35 U.S.C. 154(b) by 50 days.

(21) Appl. No.: 12/820,423

(22) Filed: Jun. 22, 2010

(51) Int. Cl.
*F41G 1/38* (2006.01)

(52) U.S. Cl. ..... 42/125; 42/119; 42/122

(58) Field of Classification Search ..... 42/125, 42/119, 122, 133
See application file for complete search history.

(56) References Cited

U.S. PATENT DOCUMENTS

| | | | | |
|---|---|---|---|---|
| 2,699,141 | A * | 1/1955 | Gaguski | 116/332 |
| 3,826,012 | A | 7/1974 | Pachmayr | |
| 3,904,279 | A * | 9/1975 | Sanada | 359/827 |
| 3,990,155 | A * | 11/1976 | Akin et al. | 42/122 |
| 4,020,203 | A * | 4/1977 | Thuler | 250/458.1 |
| 4,285,137 | A * | 8/1981 | Jennie | 42/122 |
| 4,373,269 | A * | 2/1983 | Doliber et al. | 42/122 |
| 4,554,745 | A * | 11/1985 | Repa | 42/126 |
| 4,822,994 | A * | 4/1989 | Johnson et al. | 250/214 VT |
| 5,044,304 | A * | 9/1991 | Tomita | 116/286 |
| 6,279,259 | B1 * | 8/2001 | Otteman | 42/122 |
| 6,499,191 | B1 * | 12/2002 | Howie, Jr. | 16/441 |
| 6,508,026 | B1 * | 1/2003 | Uppiano et al. | 42/119 |
| 6,608,272 | B2 * | 8/2003 | Garcia | 200/316 |
| 6,691,447 | B1 * | 2/2004 | Otteman | 42/122 |
| 6,860,224 | B2 * | 3/2005 | Snider | 116/310 |
| 6,862,832 | B2 * | 3/2005 | Barrett | 42/119 |
| 7,203,998 | B2 * | 4/2007 | Howie, Jr. | 16/441 |
| 7,415,791 | B2 * | 8/2008 | Williams et al. | 42/122 |
| 7,612,952 | B2 * | 11/2009 | Schafer | 359/813 |
| 7,793,456 | B1 * | 9/2010 | Lacorte | 42/122 |
| 7,827,725 | B1 * | 11/2010 | Hagler | 42/127 |
| 2003/0131516 | A1 * | 7/2003 | Blomdahl | 42/111 |
| 2003/0192224 | A1 * | 10/2003 | Kirk | 42/124 |
| 2004/0088898 | A1 * | 5/2004 | Barrett | 42/119 |
| 2004/0144013 | A1 * | 7/2004 | Leatherwood | 42/126 |
| 2004/0148841 | A1 * | 8/2004 | Burzel | 42/123 |
| 2005/0201076 | A1 * | 9/2005 | Marcelle et al. | 362/23 |
| 2005/0252065 | A1 * | 11/2005 | Scherpf | 42/123 |
| 2006/0171136 | A1 * | 8/2006 | Horoho et al. | 362/23 |
| 2007/0103884 | A1 * | 5/2007 | Popowich et al. | 362/29 |
| 2007/0137089 | A1 * | 6/2007 | William et al. | 42/122 |
| 2007/0175080 | A1 * | 8/2007 | Sammut et al. | 42/126 |
| 2007/0195513 | A1 * | 8/2007 | Nishiyama et al. | 362/23 |
| 2008/0023309 | A1 * | 1/2008 | Montalvo | 200/332 |
| 2009/0064561 | A1 | 3/2009 | Piltonen | |
| 2009/0241399 | A1 * | 10/2009 | Hamilton | 42/119 |
| 2010/0229451 | A1 * | 9/2010 | Hamilton | 42/126 |

FOREIGN PATENT DOCUMENTS

WO WO 2010/008810 1/2010

* cited by examiner

*Primary Examiner* — Michelle Clement
(74) *Attorney, Agent, or Firm* — Donald J. Ersler

(57) ABSTRACT

A rifle scope indicia system preferably includes a mounting base, a marker turret and a plurality of marker pins. The mounting base is attached to a top of an elevation turret of a rifle scope. The marker turret includes a plurality of marker openings formed at a perimeter thereof for receiving the plurality of marker pins. The marker turret is preferably removably attachable to the mounting base. The plurality of marker pins may be illuminated with an illumination circuit. A light emitting device of the illumination circuit is retained in an internal cavity of the marker turret. An illumination conduction ring is placed below the marker turret to illuminate any translucent marker pins. A reference marker pin inserted into the marker turret may be coordinated with a marker applied to the parallax wheel or the parallax bell of a rifle scope.

20 Claims, 12 Drawing Sheets

RIFLE SCOPE INDICIA SYSTEM

BACKGROUND OF THE INVENTION

1. Field of the Invention

The present invention relates generally to rifle scopes and more specifically to a rifle scope indicia system, which allows a user to instantly set the scope for a predetermined distance shot.

2. Discussion of the Prior Art

U.S. Pat. No. 3,826,012 to Pachmayr discloses a direct reading gun sight adjustment. The Pachmayr patent includes a gun sight, which is adjustable to introduce a variable elevation correction into the sighting of a target, and which has a scale or scales reading directly in terms of the proper gun to target distance for any particular setting of the sight. However, the scale(s) are specific to particular cartridge/load combinations and must be changed accordingly.

Patent application no. 2009/0064561 to Piltonen discloses a memory indicia system for an optical rifle scope and a method for forming an individual alignment ranger in an optical scope. The Piltonen invention includes a basic indicia indicator, which is to be attached to the elevation turret of an optical scope, and one or more additional indicia components to be attached on the basic indicia indicator. However, the indicia components are specific to particular cartridge/load combinations and cannot be freely altered independently of each other.

Patent publication no. WO 2010/008810 to Windauer discloses a operator selectable stop turret knob. The Windauer invention includes a turret knob with an adjustable member, an engagement member and a plurality of stop members.

Accordingly, there is a clearly felt need in the art for a rifle scope indicia system, which allows a user to instantly set the scope for any of a number of predetermined distance shots as determined by test firings.

SUMMARY OF THE INVENTION

The present invention provides a rifle scope indicia system, which allows a user to instantly set the scope for a predetermined distance shot. The rifle scope indicia system preferably includes a mounting base, a marker turret and a plurality of marker pins. The mounting base is attached to a top of an elevation turret of a rifle scope with any suitable method, such as double sided adhesive material. The marker turret includes a plurality of marker openings formed at an outer perimeter of the marker turret for receiving the plurality of marker pins. The plurality of marker pins preferably include different colors and/or different heights. The marker pins may also be made translucent to allow light to be transmitted therethrough. Each one of the plurality of marker openings is sized to receive a single marker pin. The marker turret is removably attachable to the mounting base with fasteners or any other suitable method. However, the marker turret could be attached directly to the elevation turret or incorporated directly into the design of the elevation turret.

The marker turret may also be attached to a screw head elevation turret with a screw head adapter; a finger bar elevation turret with a finger bar adapter; and a target/tactical elevation turret with a target/tactical adapter.

The marker pins may be illuminated with an illumination assembly. The illumination assembly includes a circuit board and a control switch. The circuit board is retained in an internal cavity of the marker turret. An illumination conduction ring is placed below the marker turret. Light flows to the illumination conduction ring and internally illuminates any translucent marker pins inserted into the marker openings. An illumination cover is placed over a top of the marker turret. A weatherizing skirt may be placed over the mounting base to cover the mounting base and a top portion of the elevation turret to protect the double sided adhesive material or the like from water and/or dust penetration. A specific marker pin inserted into the marker turret may be coordinated with a wheel marker applied to the parallax wheel. The reference marker pin may also be coordinated with a bell marker applied to the parallax bell.

Accordingly, it is an object of the present invention to provide a rifle scope indicia system, which allows a user to instantly set the scope for any of a number of predetermined distance shots as determined by test firings.

These and additional objects, advantages, features and benefits of the present invention will become apparent from the following specification.

DETAILED DESCRIPTION OF THE PREFERRED EMBODIMENTS

Figure 1:
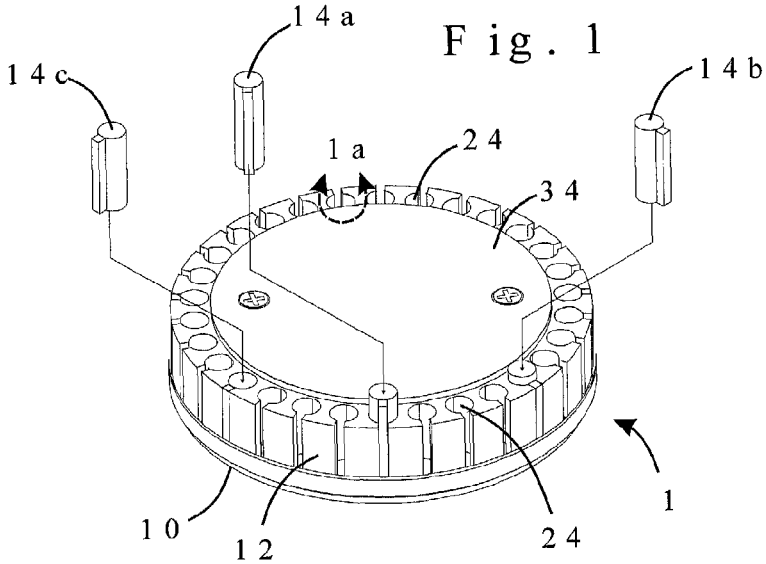
FIG. 1 is a perspective view of a rifle scope indicia system with three marker pins shown inserted therein and the three marker pins located above the assembled rifle scope indicia in accordance with the present invention.
Figure 2:
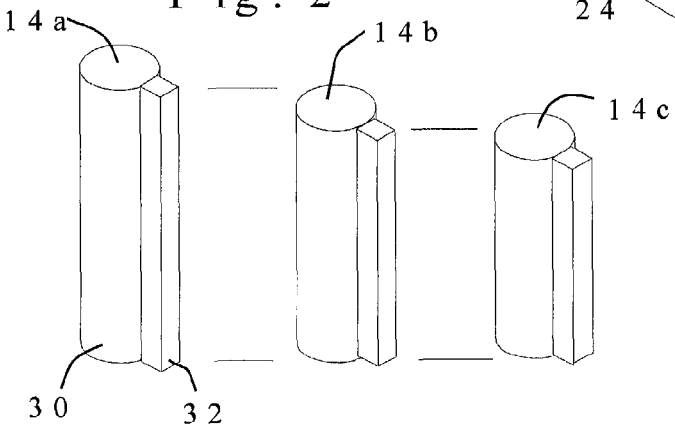
FIG. 2 is a perspective view of three marker pins having different heights of a rifle scope indicia system in accordance with the present invention.
Figure 3:
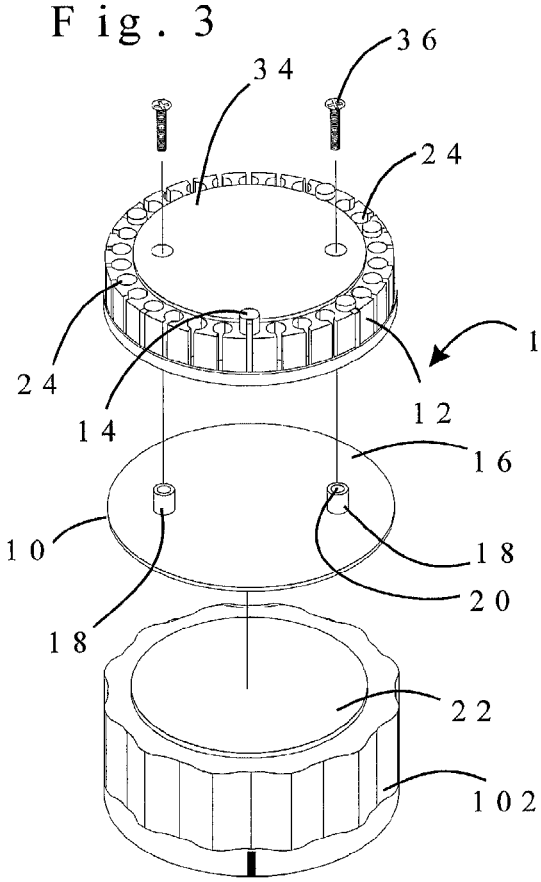
FIG. 3 is a partially exploded perspective view of a rifle scope indicia system and an elevation turret in accordance with the present invention.
Figure 22:
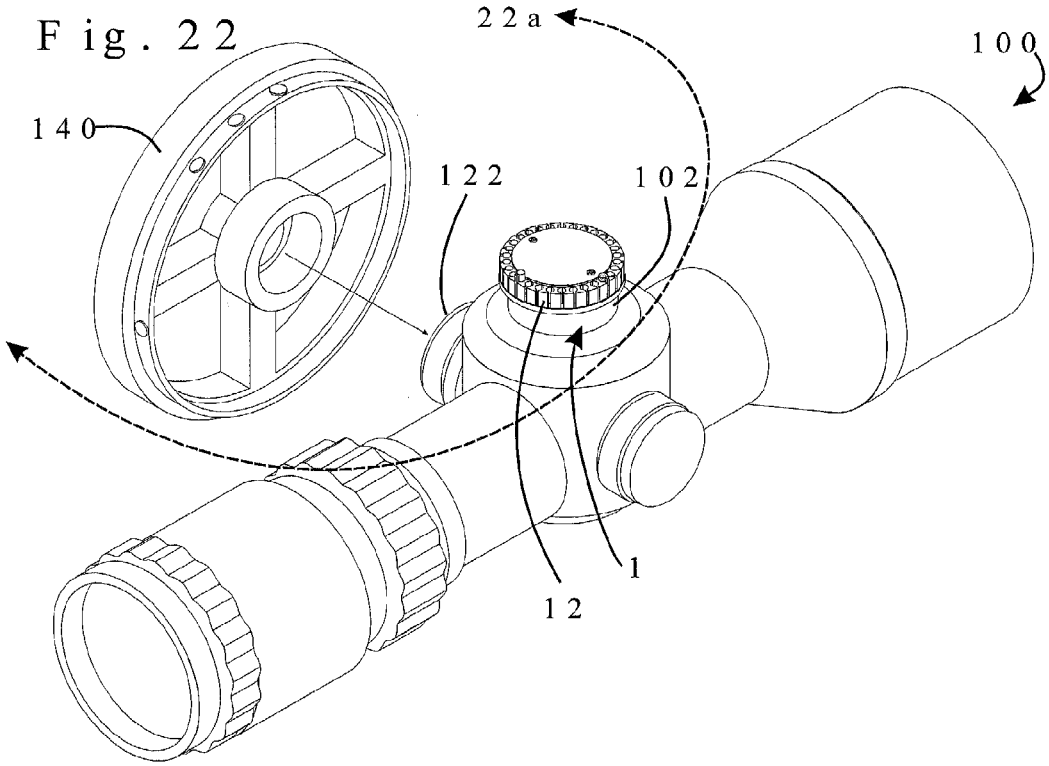
FIG. 22 is a partially exploded perspective view of a parallax wheel with a plurality of self-adhesive wheel markers applied thereto and a rifle scope indicia system attached to an elevation turret of a rifle scope in accordance with the present invention.
Figure 22:
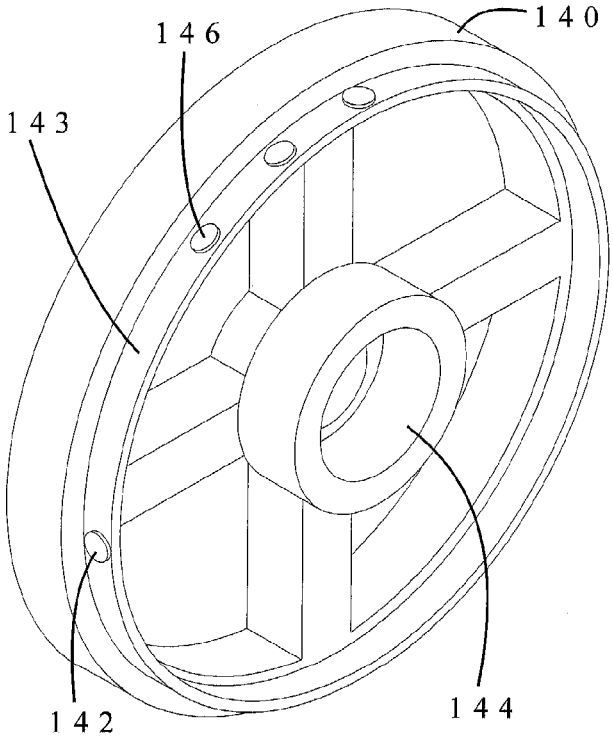

With reference now to the drawings, and particularly to FIG. 1, there is shown a perspective view of a rifle scope indicia system 1. With reference to FIGS. 2-3, the rifle scope indicia system 1 preferably includes a mounting base 10, a marker turret 12 and a plurality of marker pins 14*a*, 14*b*, 14*c*. The mounting base 10 preferably includes an attachment base 16 and at least one fastener post 18. The fastener post 18 includes a female thread 20. With reference to FIG. 22, the mounting base 10 is attached to a top of an elevation turret 102 of a rifle scope 100 with any suitable method, such as double sided adhesive material 22. The marker turret 12 includes a plurality of marker openings 24 formed at an outer perimeter for receiving the plurality of marker pins 14*a*, 14*b*, 14*c*.

Figure 1A:
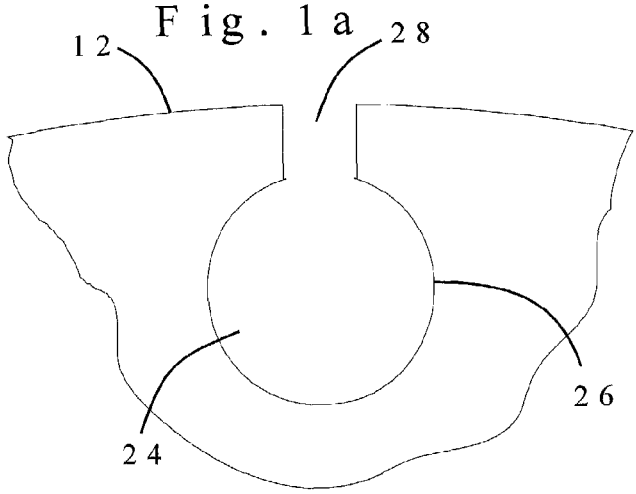
FIG. 1*a* is an enlarged top view of a marker opening formed in a marker turret of a rifle scope indicia system in accordance with the present invention.

With reference to FIG. 1*a*, each marker opening 24 preferably includes a bore portion 26 and a slot portion 28. The slot portion 28 is formed through a perimeter of the marker turret 12 and communicates with the bore portion 26. Each marker pin 14 preferably includes a cylindrical portion 30 and a key portion 32. The key portion 32 extends from a perimeter of the cylindrical portion 30. The marker opening 24 is sized to firmly receive the marker pin 14. The plurality of marker pins 14 may have different colors, different heights or other indicia. Providing marker pins 14 with different heights provides tactile identification of the marker pins 14 to a user. For example, it would be beneficial to have to have a reference distance marker pin with a white color and the greatest height. Some of the marker pins 14 could be made translucent to allow light to be transmitted therethrough for night time shooting conditions. The plurality of marker pins 14 may have other indicia to differentiate them from each other or a reference marker pin 14*a*.

Figure 4:
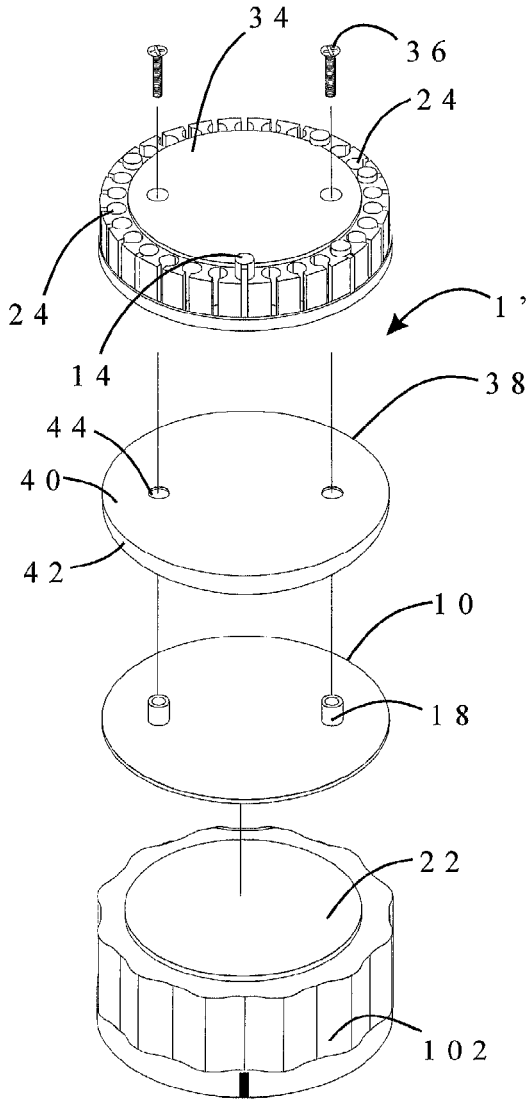
FIG. 4 is a partially exploded perspective view of a rifle scope indicia system including a weatherizing skirt and an elevation turret in accordance with the present invention.

A turret cover 34 and at least one fastener 36 are preferably used to removably secure the marker turret 12 to the mounting base 10, but other attachment methods may also be used. The female thread 20 is sized to threadably receive the fastener 36. The marker turret 24 could also be attached directly to the elevation turret 102 with double sided adhesive material or the like. With reference to FIG. 4, the rifle scope indicia system 1' includes the rifle scope indicia system 1 and a weatherizing skirt 38.

The weatherizing skirt 38 includes a skirt disc 40 and a cover flange 42. The cover flange 42 extends downward from an outer perimeter of the skirt disc 40 and preferably has a diameter, which is slightly less than that of the elevation turret 102. At least one post clearance hole 44 is formed through the skirt disc 40 to provide clearance for the at least one fastener post 18. The weatherizing skirt 38 may be placed over the mounting base 10 to cover the mounting base 10 and a top portion of the elevation turret 102 to protect the double sided adhesive material 22 or the like and the internal components of the rifle scope indicia system 1 from water and or dust penetration.

Figure 5:
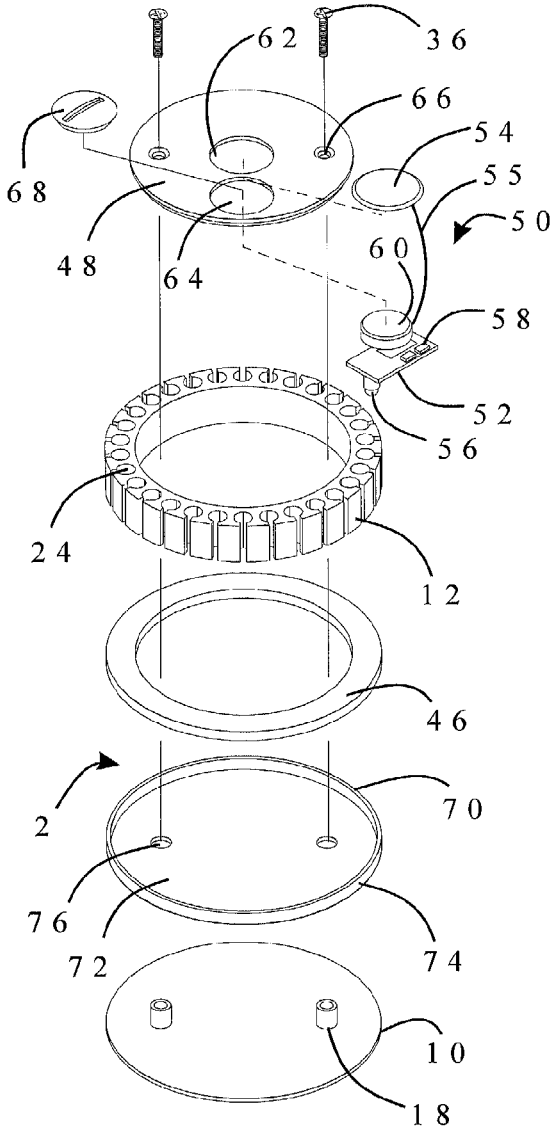
FIG. 5 is an exploded perspective view of a rifle scope indicia system including an illumination assembly in accordance with the present invention.
Figure 7:
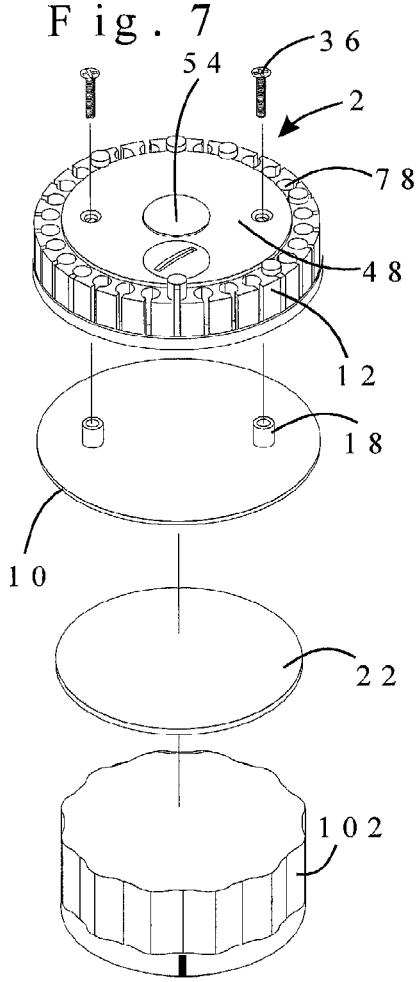
FIG. 7 is a partially exploded perspective view of a rifle scope indicia system including an illumination assembly and an elevation turret in accordance with the present invention.
Figure 6:
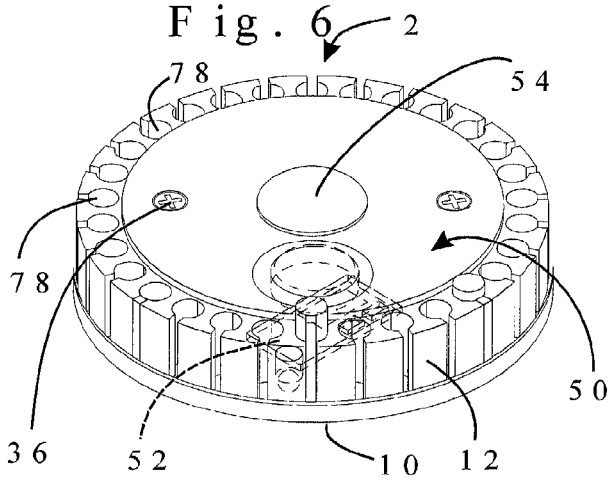
FIG. 6 is a perspective view of a rifle scope indicia system including an illumination assembly in accordance with the present invention.
Figure 8:
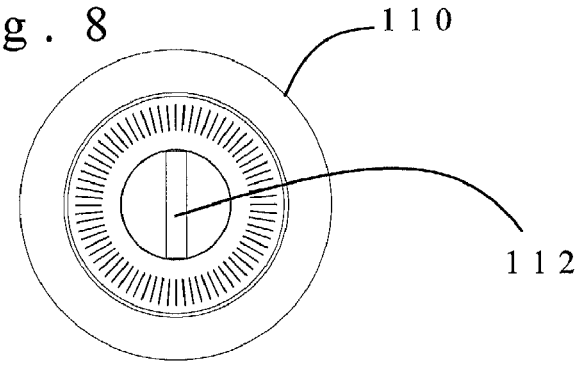
FIG. 8 is a top view of a screw head elevation turret.
Figure 9:
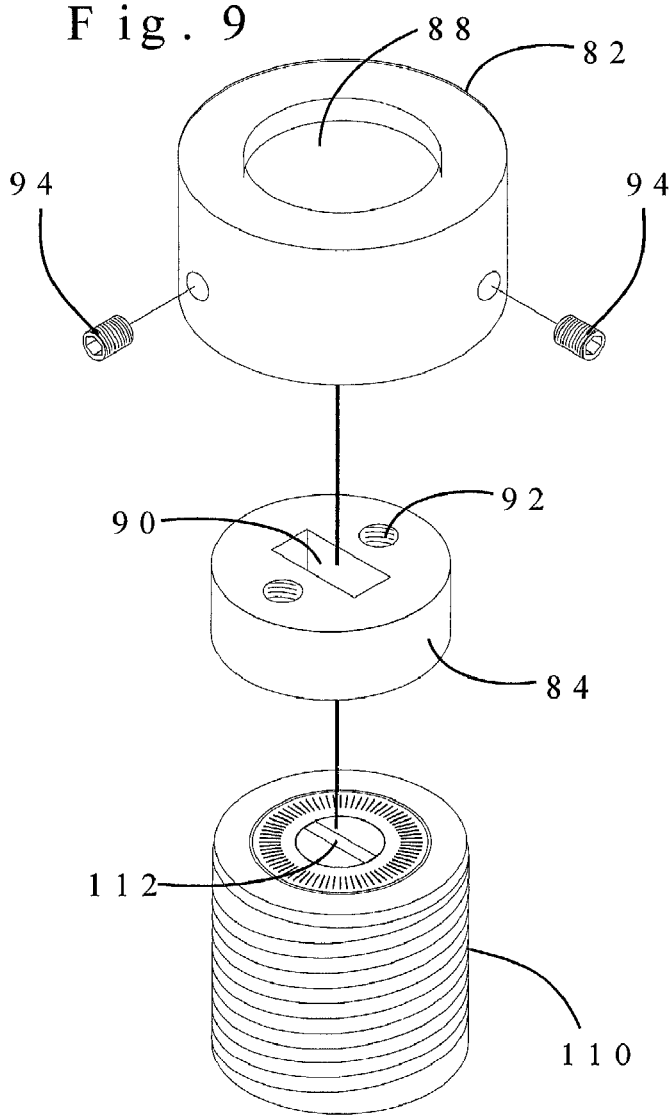
FIG. 9 is an exploded perspective view of a screw head adapter for a screw head elevation turret for attachment of a rifle scope indicia system in accordance with the present invention.
Figure 10:
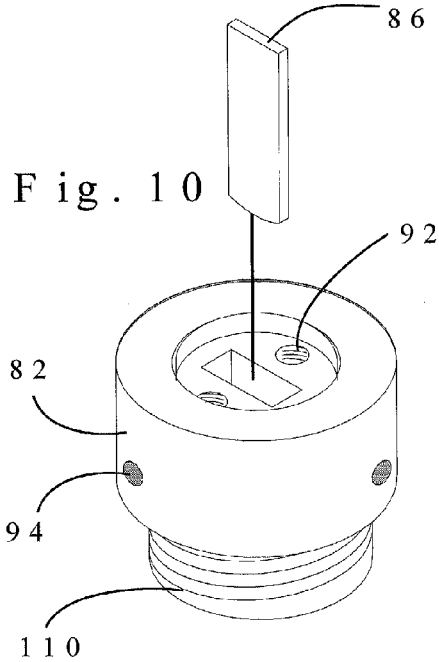
FIG. 10 is a partially exploded perspective view of a screw head adapter and an orientation key for a screw head elevation turret for attachment of a rifle scope indicia system in accordance with the present invention.
Figure 11:
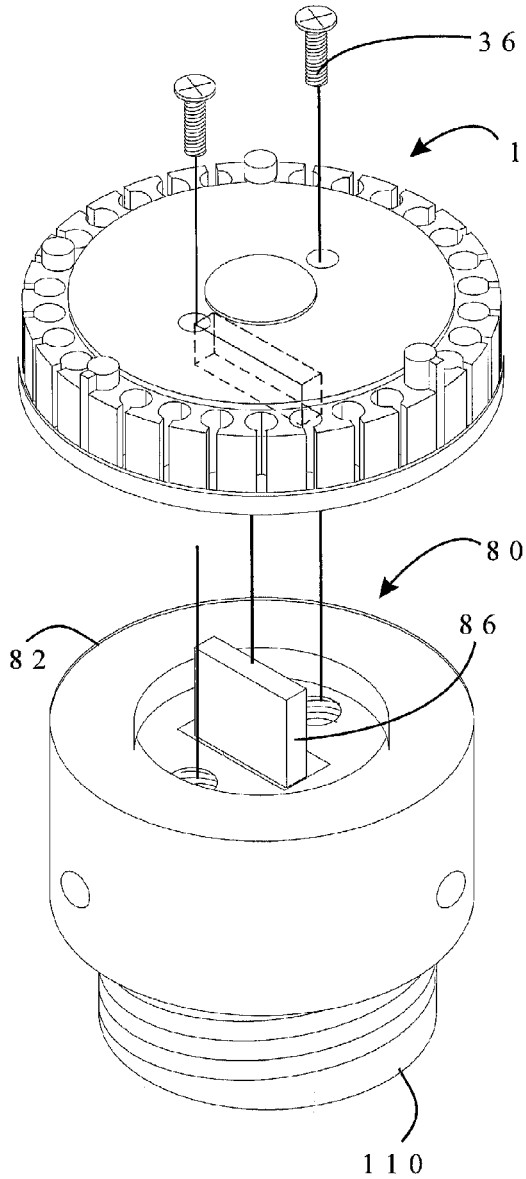
FIG. 11 is a partially exploded perspective view of a screw head adapter attached to a screw head elevation turret before attachment of a rifle scope indicia system to the screw head elevation turret in accordance with the present invention.
Figure 12:
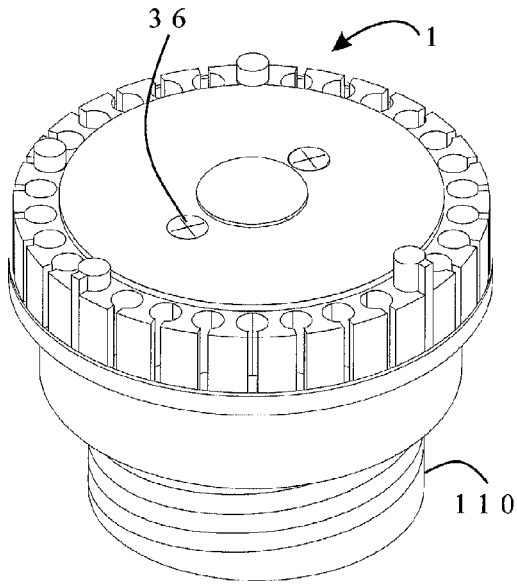
FIG. 12 is a perspective view of a rifle scope indicia system attached to a screw head elevation turret in accordance with the present invention.
Figure 13:
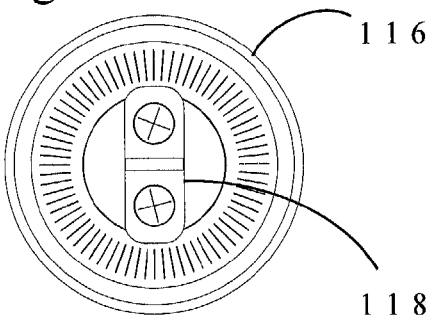
FIG. 13 is a top view of a finger bar elevation turret.
Figure 14:
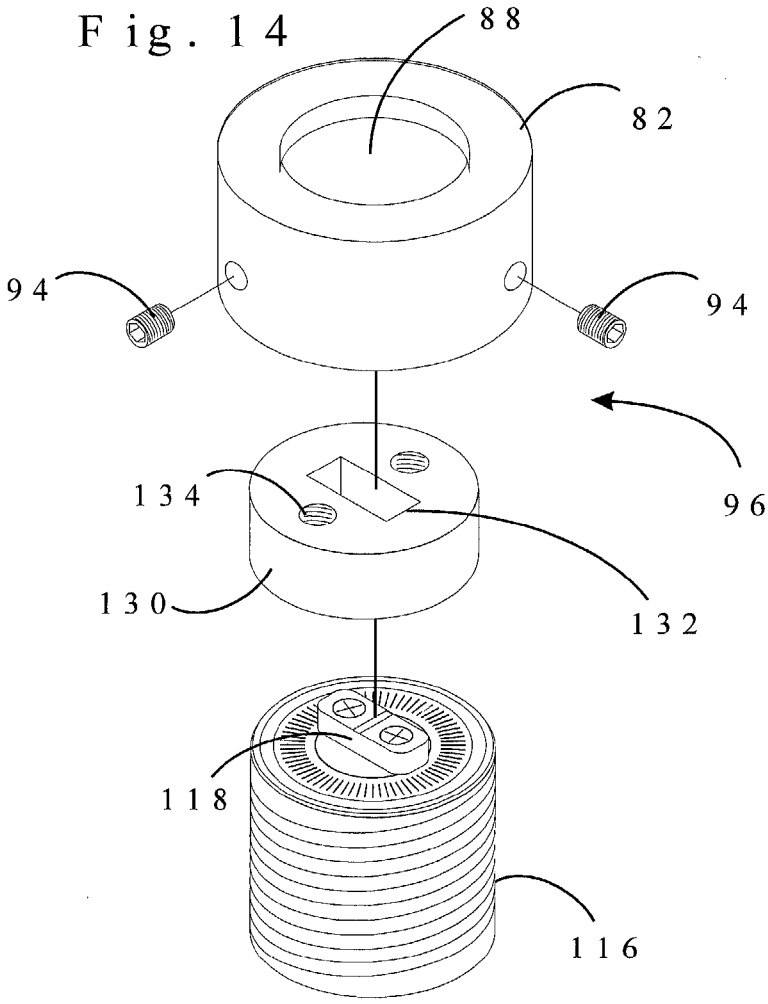
FIG. 14 is an exploded perspective view of a finger bar adapter for a finger bar elevation turret for attachment of a rifle scope indicia system in accordance with the present invention.
Figure 15:
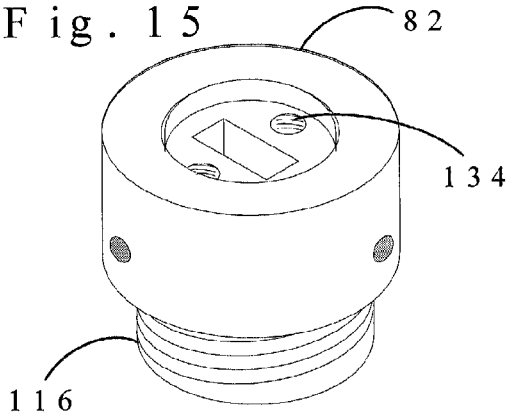
FIG. 15 is perspective view of a finger bar adapter attached to a finger bar elevation turret for attachment of a rifle scope indicia system in accordance with the present invention.
Figure 16:
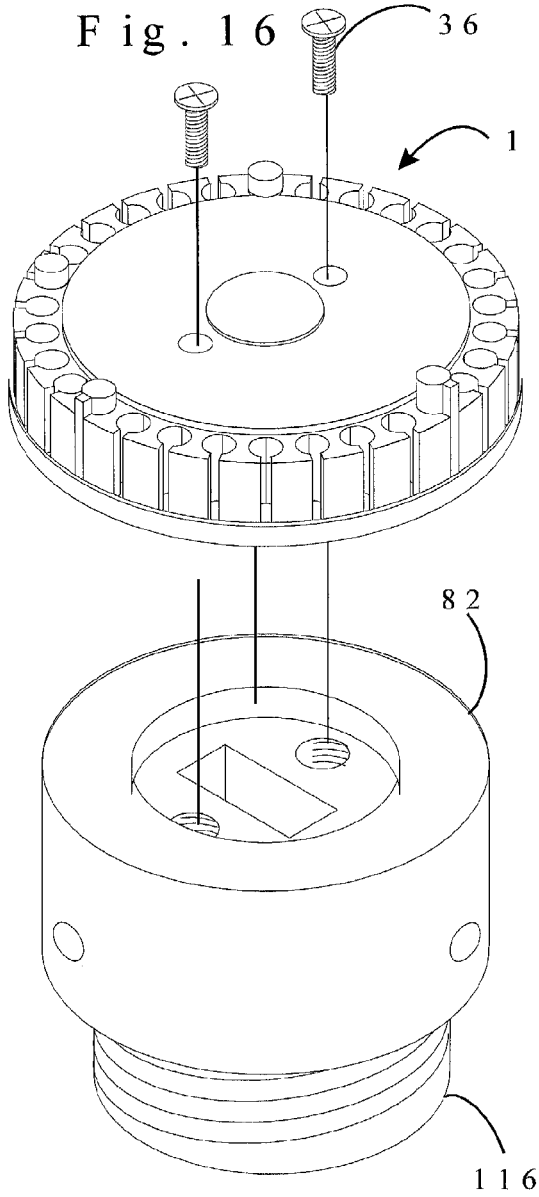
FIG. 16 is a partially exploded perspective view of a finger bar adapter attached to a finger bar elevation turret, before attachment of a rifle scope indicia system to the finger bar elevation turret in accordance with the present invention.
Figure 17:
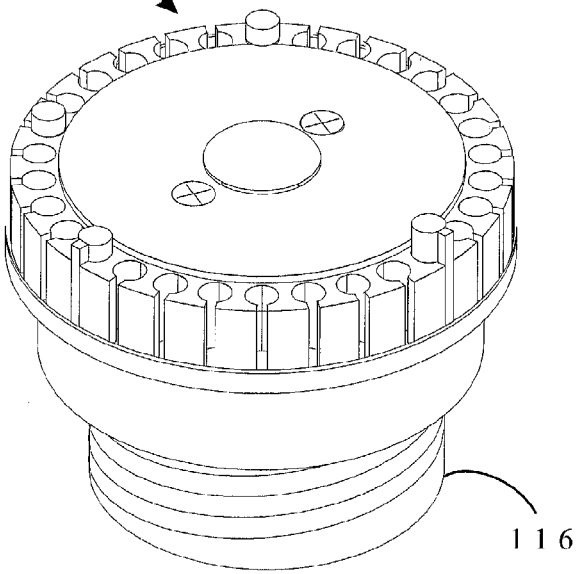
FIG. 17 is a perspective view of a rifle scope indicia system attached to a finger bar elevation turret with a finger bar adapter in accordance with the present invention.
Figure 18:
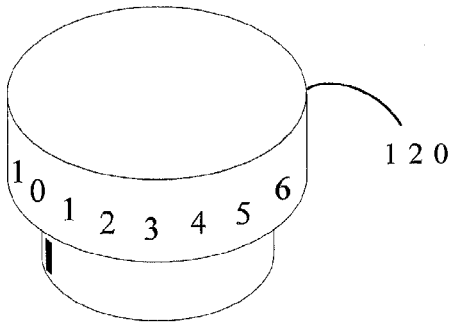
FIG. 18 is a perspective view of a target/tactical elevation turret.
Figure 19:
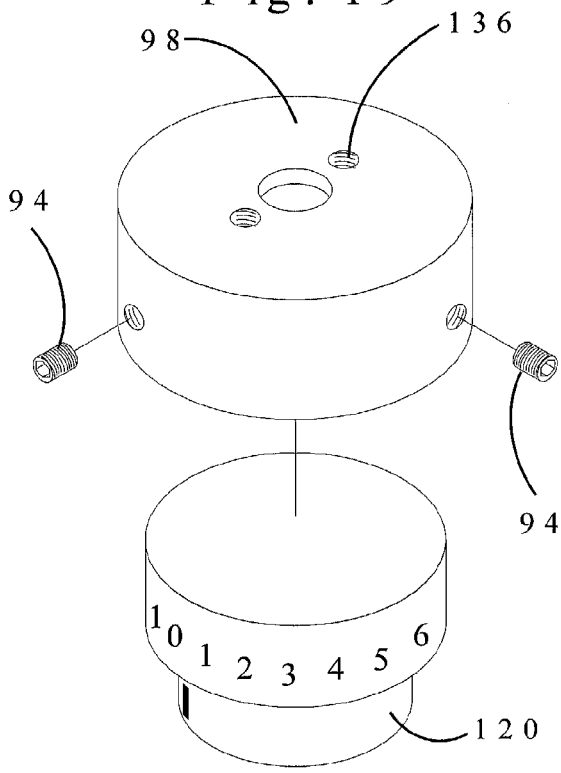
FIG. 19 is an exploded perspective view of a target/tactical adapter for a target/tactical elevation turret for attachment of a rifle scope indicia system in accordance with the present invention.
Figure 20:
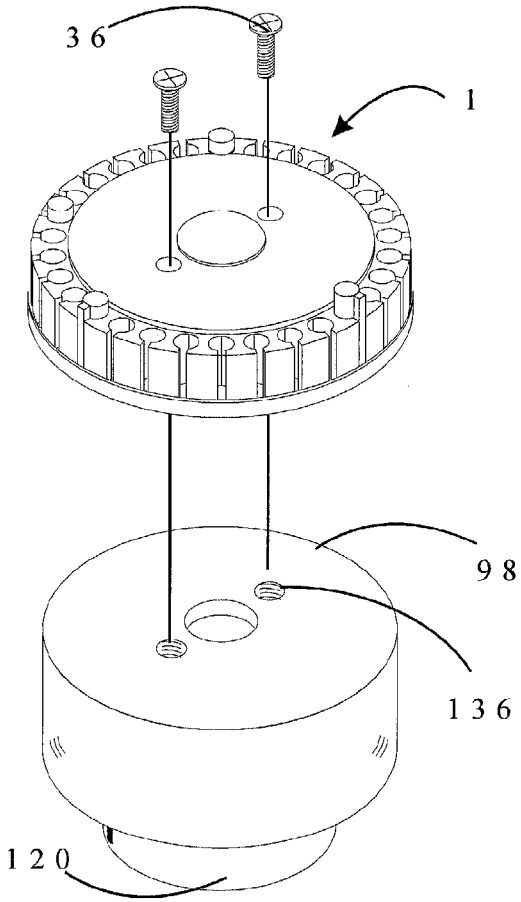
FIG. 20 is a partially exploded perspective view of a target/tactical adapter attached to a target/tactical elevation turret before attachment of a rifle scope indicia system to the target/tactical elevation turret in accordance with the present invention.
Figure 21:
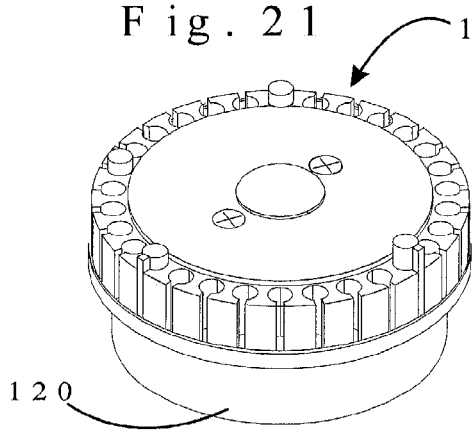
FIG. 21 is a perspective view of a rifle scope indicia system attached to a target/tactical elevation turret with a target/tactical adapter in accordance with the present invention.

With reference to FIGS. 5-7, a rifle scope indicia system 2 includes the mounting base 10, the marker turret 12, the plurality of marker pins 14, an illumination conduction ring 46, an illumination cover 48 and an illumination assembly 50. The illumination assembly 50 includes a circuit board 52 and a control switch 54. The circuit board 52 includes a light emitting device 56, an illumination circuit 58 and a battery 60. The illumination circuit 58 is powered by the battery 60 and the illumination circuit 58 drives the light emitting device 56. The light emitting device 56 could be a visible color LED, an infrared LED, or any other appropriately sized light source. The circuit board 52 is retained in an internal cavity of the marker turret 12. The control switch 54 is electrically connected to the illumination circuit 58 through wire 55 to control electrical power to the light emitting device 56.

The illumination cover 48 includes a switch hole 62, a battery access hole 64 and at least one screw hole 66. The illumination cover 48 and the battery 60 are positioned, such that the battery 60 is concentric with the battery access hole 64. A battery access cap 68 is screwed into the battery access hole 64. The control switch 54 is retained in the switch hole 62. Alternatively, the control switch 54 and the battery 60 may be combined into a single removable unit, which would eliminate the battery access hole 64 and the battery access cap 68. The illumination conduction ring 46 is positioned below the plurality of marker openings 24.

A location plate 70 preferably concentrically aligns the illumination conduction ring 46 with the plurality of marker openings 24. The location plate 70 includes a base disc 72 and a flange ring 74. The flange ring 74 extends upward from an outer perimeter of the base disc 72 and prevents light from escaping from the marker turret 12 around the lower perimeter thereof. An inner perimeter of the flange ring 74 is sized to receive an outer perimeter of the illumination conduction ring 46. At least one post hole 76 is formed through the base disc 72 to provide clearance for the at least one post 18. A plurality of opaque maker filler pins 78 must be inserted into all the empty marker openings 24 not used by marker pins 14*a*, 14*b*, 14*c* to prevent leakage of light from the light emitting device 56. The marker turret 24 is secured to the mounting base 10 with the at least one fastener 36. The mounting base 10 is secured to the elevation turret 102 with double sided adhesive material 22 or the like. The weatherizing skirt 38 may be placed over the mounting base 10, before placement of the location plate 70. Light from the light emitting device 56 is transmitted to the illumination conduction ring 46, the light travels through the illumination conduction ring 46 and travels into any translucent marker pin 14*a*, 14*b*, 14*c*. The light from the light emitting device 56 travels through the key portion 32 of the plurality of translucent markers pins 14*a*, 14*b*, 14*c* for viewing by a user. The key portions 32 present easily distinguishable illuminated vertical lines in contrast against the general surface of the marker turret 12.

With reference to FIGS. 8-12, a screw head adapter 80 is used to secure the rifle scope indicia system 1 to a screw head elevation turret 110. The screw head elevation turret 110 includes a turret key slot 112. The screw head adapter 80 includes an adapter sleeve 82, a key receiver member 84 and a key insert 86. The adapter sleeve 82 includes a downward facing counterbore for receiving the key receiver member 84 and the screw head elevation turret 110. An access opening 88 is formed through a top of the adapter sleeve 82. The key receiver member 84 includes a key slot 90 and at least one threaded tap 92. The key receiver member 84 is placed on top of the screw head elevation turret 110 and the key insert 86 is inserted through the key slot 90 and into the turret key slot 112. The adapter sleeve 82 is placed over the key receiver member 84 and the screw head elevation turret 110. At least one set screw 94 is threaded through a side of the adapter sleeve 82 and tightened against the outer diameter of the screw head elevation turret 110. The rifle scope indicia system 1 is secured to the key receiver member 84 by screwing the at least one fastener 36 into the at least one threaded tap 92.

With reference to FIGS. 13-17, a finger bar adapter 96 is used to secure the rifle scope indicia system 1 to a finger bar elevation turret 116. The finger bar elevation turret 116 includes a turret key 118. The finger bar adapter 96 includes the adapter sleeve 82 and a key receiver member 130. The adapter sleeve 82 includes a downward facing counterbore for receiving the key receiver member 130 and the elevation turret 116. The key receiver member 130 includes a key slot 132 and at least one threaded tap 134. The key slot 132 is sized to receive the turret key 118. The turret key 118 is inserted into the key slot 132, when the key receiver member 130 is placed on the finger bar elevation turret 116. The adapter sleeve 82 is placed over the key receiver member 130 and the finger bar elevation turret 116. At least one set screw 94 is threaded through a side of the adapter sleeve 82 and tightened against the outer diameter of the finger bar elevation turret 116. The rifle scope indicia system 1 is secured to the key receiver member 130 by screwing the at least one fastener 36 into the at least one threaded tap 134.

With reference to FIGS. 18-21, a target/tactical head adapter 98 is used to secure the rifle scope indicia system 1 to a target/tactical elevation turret 120, when the use of the double sided adhesive material 22 is not desired. The target/tactical adapter 98 includes a downward facing counterbore and at least one threaded tap 136. The downward facing counterbore is sized to receive the target/tactical elevation turret 120. The adapter sleeve 98 is placed over the target/tactical elevation turret 120. At least one set screw 94 is threaded through a side of the adapter sleeve 98 and tightened against the outer diameter of the target/tactical elevation turret 120. The rifle scope indicia system 1 is secured to the adapter sleeve 98 by screwing the at least one fastener 36 into the at least one threaded tap 136.

Figure 22A:
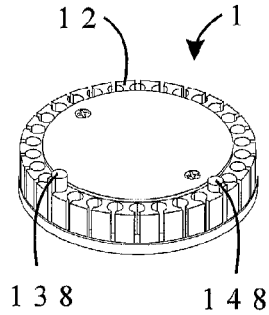
FIG. 22*a* is an enlarged perspective view of a parallax wheel with a plurality of self-adhesive wheel markers applied thereto positioned adjacent to a rifle scope indicia system in accordance with the present invention.

With reference to FIGS. 22-22*a*, a reference marker pin 138 inserted into the marker turret 12 may be coordinated with a reference self-adhesive wheel marker 142 applied to a perimeter surface 143 of a parallax wheel 140. The parallax wheel 140 includes a parallax bore 144, which is sized to firmly receive an outer diameter of a parallax turret 122 of the rifle scope 100. A second self-adhesive wheel marker 146 may be coordinated with a second marker pin 148.

Figure 23:
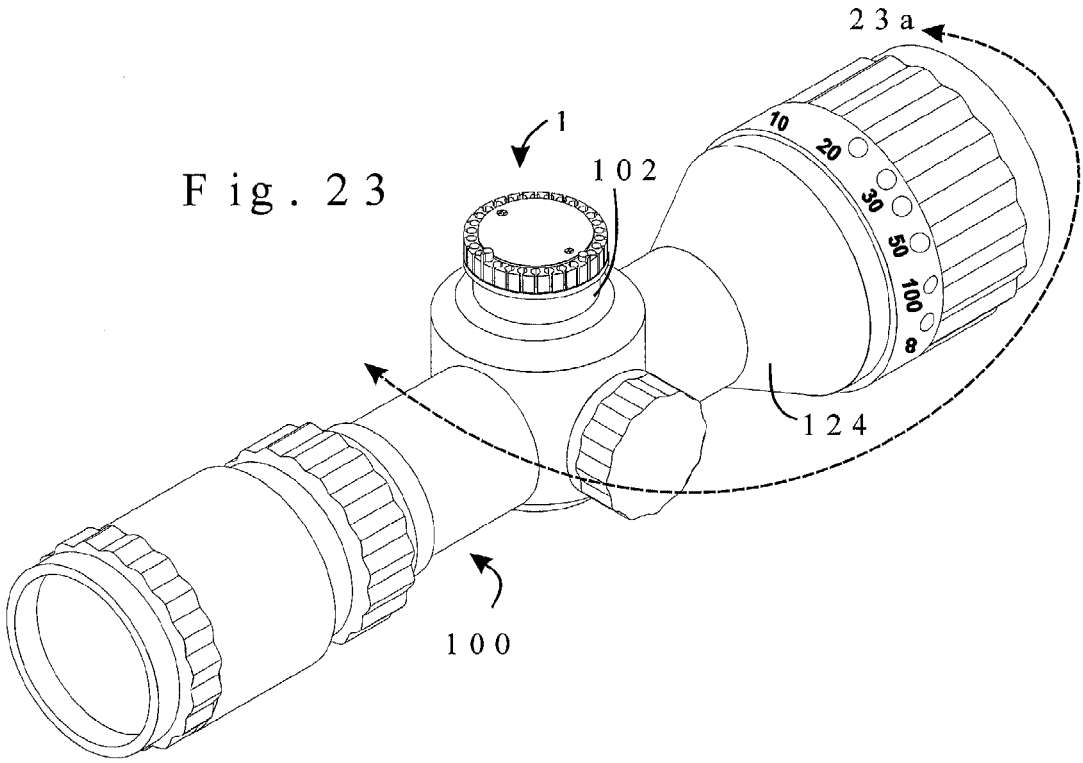
FIG. 23 is a perspective view of a parallax bell of a rifle scope with a plurality of self-adhesive bell markers applied thereto and a rifle scope indicia system attached to a elevation turret of the rifle scope in accordance with the present invention.
Figure 23A:
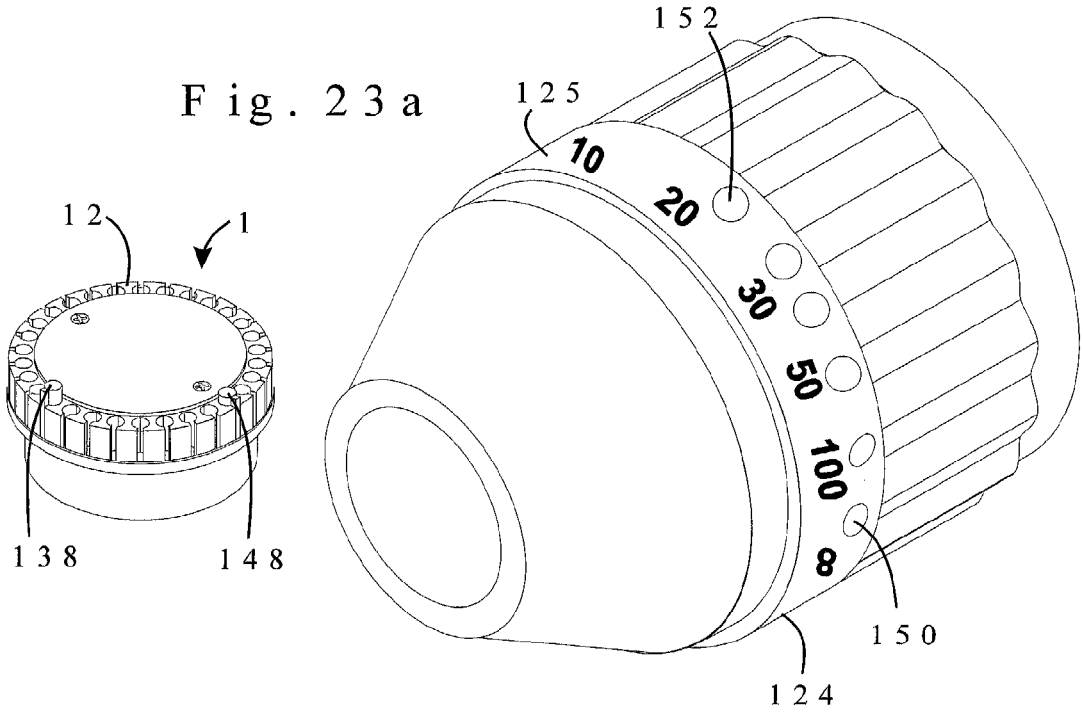
FIG. 23*a* is an enlarged perspective view of a parallax bell with a plurality of self-adhesive bell markers applied thereto positioned adjacent to a rifle scope indicia system in accordance with the present invention.

With reference to FIGS. 23-23*a*, the reference marker pin 138 inserted into the marker turret 12 may be coordinated with a reference self-adhesive bell marker 150 applied to a perimeter surface 125 of a parallax bell 124 of the rifle scope 100. A second self-adhesive bell marker 152 may also be coordinated with a second marker pin 148.

Figure 24:
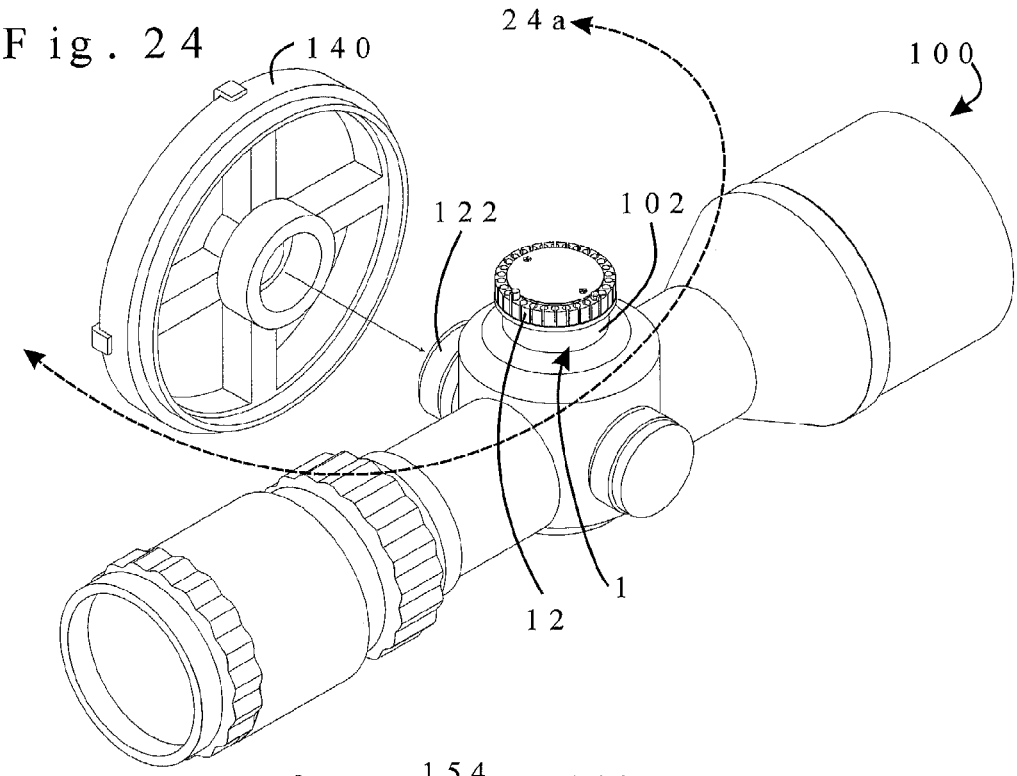
FIG. 24 is a partially exploded perspective view of a parallax wheel with a plurality of clamp markers applied thereto and a rifle scope indicia system attached to an elevation turret of a rifle scope in accordance with the present invention.
Figure 24A:
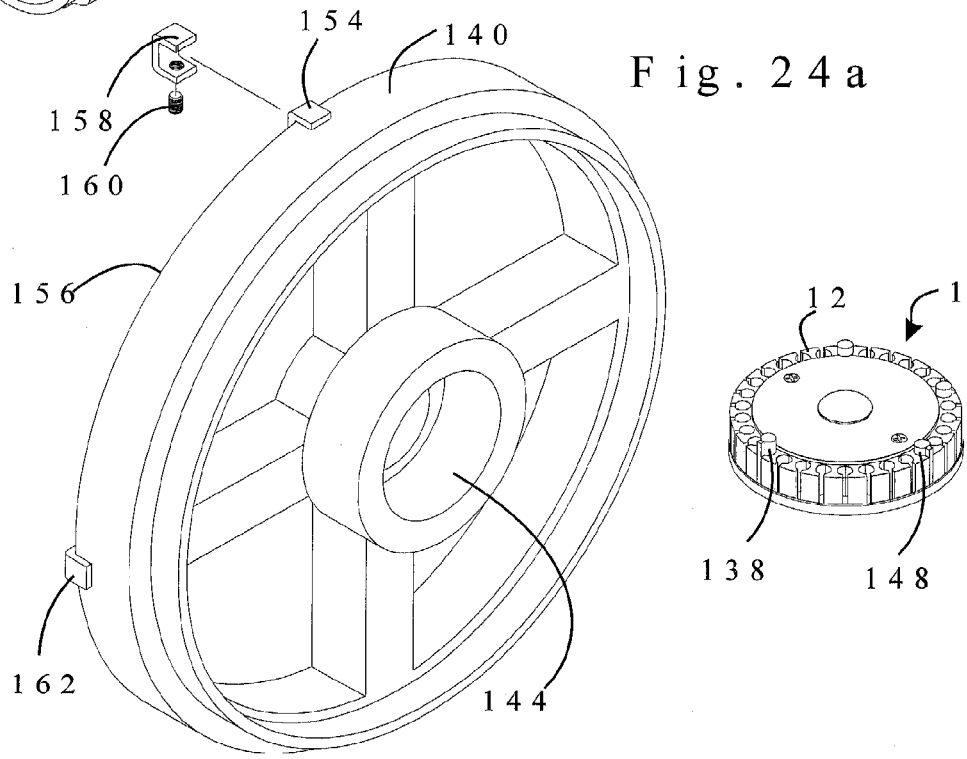
FIG. 24*a* is an enlarged perspective view of a parallax wheel with a plurality of clamp markers applied thereto positioned adjacent to a rifle scope indicia system in accordance with the present invention.

With reference to FIGS. 24-24*a*, a reference marker pin 138 inserted into the marker turret 12 may be coordinated with a reference clamp marker 154 applied to an outer rim 156 of a parallax wheel 140. The reference clamp marker 154 includes a U-shaped clip 158 and a set screw 160. The U-shaped clip 158 is inserted over an edge of the outer rim 156 and secured thereto with the set screw 160. A second clamp marker 162 may be coordinated with a second marker pin 148.

Figure 25:
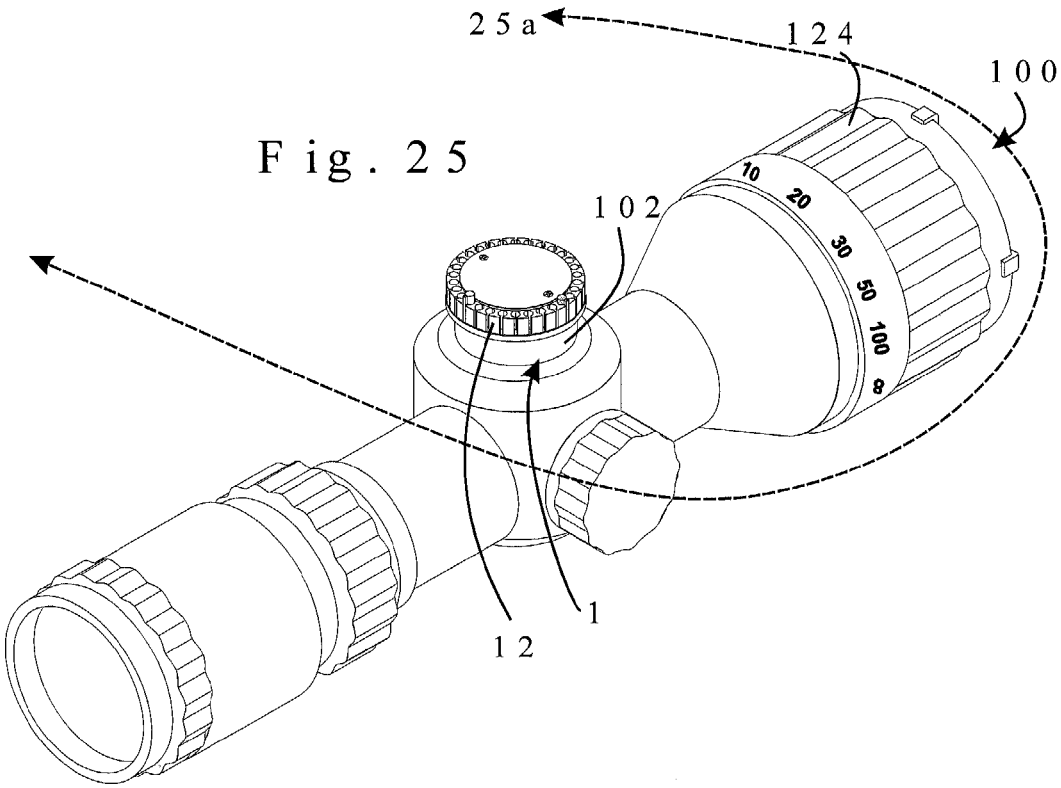
FIG. 25 is a perspective view of a parallax bell of a rifle scope with a plurality of clamp markers applied thereto and a rifle scope indicia system attached to a elevation turret of the rifle scope in accordance with the present invention.
Figure 25A:
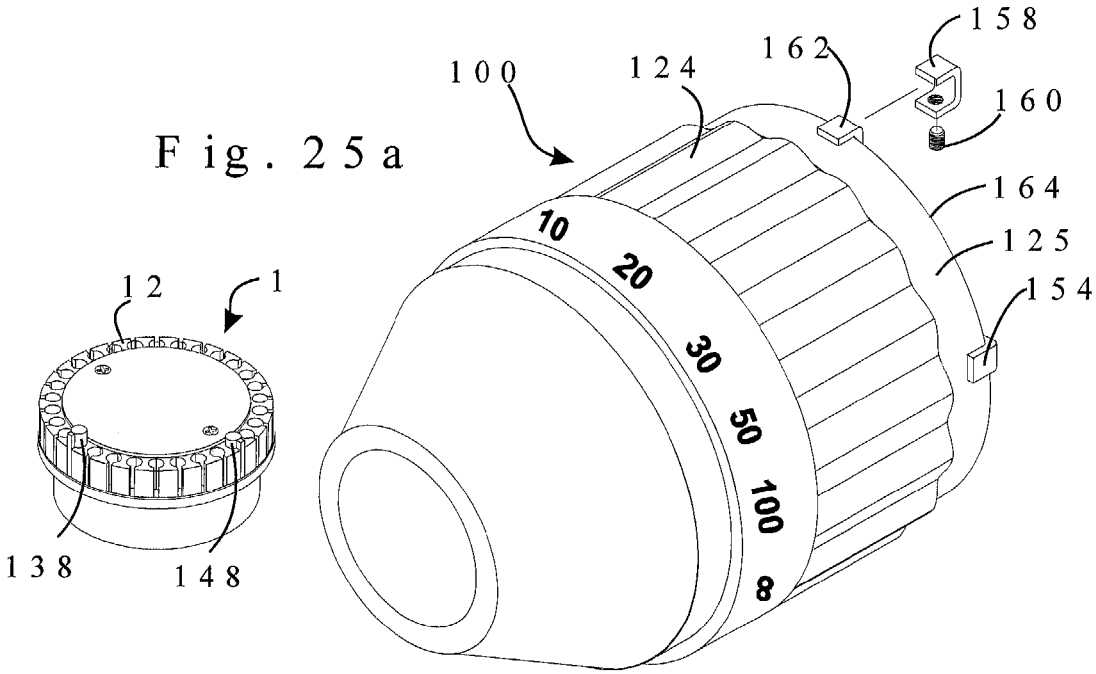
FIG. 25*a* is an enlarged perspective view of a parallax bell with a plurality of clamp markers applied thereto positioned adjacent to a rifle scope indicia system in accordance with the present invention.

With reference to FIGS. 25-25*a*, the reference marker pin 138 inserted into the marker turret 12 may be coordinated with the reference clamp marker 154 applied to an outer rim 164 of a parallax bell 124 of the rifle scope 100. A second clamp marker 162 may also be coordinated with a second marker pin 148.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A firearm scope indicia system comprising:

a marker turret including a plurality of marker openings formed around substantially an outer perimeter thereof, said plurality of marker openings have an elongated length and a perimeter shape, wherein said marker turret is secured to an elevation turret of the firearm scope; and at least one marker pin having an elongated length and a perimeter shape, said perimeter shape of said at least one marker pin is sized to be firmly received by one of said plurality of marker openings, a portion of said at least one marker pin is viewable after insertion into said marker turret, a reference one of said at least one marker pin represents a distance to a target.

2. The firearm scope indicia system of claim 1 wherein:

each one of said plurality of marker openings includes a bore portion and a slot portion, said slot portion communicating with said bore portion, said slot portion breaking through an outer perimeter of said market turret.

3. The firearm scope indicia system of claim 1, further comprising:

an illumination device includes a light emitting device and a power source, said light emitting device is retained in an internal cavity of said marker turret.

4. The firearm scope indicia system of claim 3, further comprising:

an illumination conduction ring is located below said marker turret, said illumination conduction ring receives light from said light emitting device, the light is transmitted through at least one translucent marker pin of said at least one marker pin.

5. The firearm scope indicia system of claim 1, further comprising:

a parallax wheel including a perimeter surface, said parallax wheel is secured to a parallax turret, at least one wheel marker is retained on said parallax wheel, said at least one wheel marker is coordinated with said reference one of said at least one marker pin.

6. The firearm scope indicia system of claim 1, further comprising:

a parallax bell including a perimeter surface, at least one bell marker is applied to said parallax bell, one of said at least one bell marker is coordinated with said reference one of said at least one marker pin.

7. The firearm scope indicia system of claim 1, further comprising:

a mounting base is secured to the elevation turret of the scope, said marker turret is removably attachable to said mounting base.

8. A firearm scope indicia system comprising:

a marker turret including a plurality of marker openings formed around substantially an outer perimeter thereof, said plurality of marker openings have an elongated length and a perimeter shape, a plurality of slots are formed through an outer perimeter of said marker turret to communicate with said plurality of marker openings, wherein said marker turret is secured to an elevation turret of a firearm scope; and at least one marker pin having an elongated length and a perimeter shape, said perimeter shape of said at least one marker pin is sized to be firmly received by one of said plurality of marker openings, a portion of said at least one marker pin is viewable after insertion into said marker turret, a reference one of said at least one marker pin represents a distance to a target.

9. The firearm scope indicia system of claim 8 wherein:

each one of said at least one marker pin includes a cylindrical portion and a key portion, said key portion extends from a perimeter of said cylindrical portion.

10. The firearm scope indicia system of claim 8, further comprising:

an illumination device includes a light emitting device and a power source, said light emitting device is retained in an internal cavity of said marker turret.

11. The firearm scope indicia system of claim 10, further comprising:

an illumination conduction ring is located below said marker turret, said illumination conduction ring receives light from said light emitting device, the light is transmitted through at least one translucent marker pin of said at least one marker pin.

12. The firearm scope indicia system of claim 8, further comprising:

a parallax wheel including a perimeter surface, said parallax wheel is secured to a parallax turret, at least one wheel marker is retained on said parallax wheel, said at least one wheel marker is coordinated with said reference one of said at least one marker pin.

13. The firearm scope indicia system of claim 8, further comprising:

a parallax bell including a perimeter surface, at least one bell marker is applied to said parallax bell, one of said at least one bell marker is coordinated with said reference one of said at least one marker pin.

14. The firearm scope indicia system of claim 8, further comprising:

a mounting base is secured to the elevation turret of the scope, said marker turret is removably attachable to said mounting base.

15. A firearm scope indicia system comprising:

a marker turret including a plurality of marker openings formed around substantially an outer perimeter thereof, said plurality of marker openings have an elongated length and a perimeter shape, wherein said marker turret is secured to an elevation turret of the firearm scope; and at least two marker pins having an elongated length and a perimeter shape, said perimeter shape of said at least two marker pins are sized to be firmly received by two of said plurality of marker openings, said at least two marker pins have different heights, said different heights of said at least two marker pins providing tactile identification to a user, a reference one of said at least two marker pins represents a distance to a target.

16. The firearm scope indicia system of claim 15 wherein:

each one of said at least two marker pins includes a cylindrical portion and a key portion, said key portion extends from a perimeter of said cylindrical portion.

17. The firearm scope indicia system of claim 15, further comprising:

an illumination device includes a light emitting device and a power source, said light emitting device is retained in an internal cavity of said marker turret.

18. The firearm scope indicia system of claim 17, further comprising:

an illumination conduction ring is located below said marker turret, said illumination conduction ring receives light from said light emitting device, the light is transmitted through at least one translucent marker pin.

19. The firearm scope indicia system of claim 15, further comprising:

a parallax wheel including a perimeter surface, said parallax wheel is secured to a parallax turret, at least one wheel marker is retained on said parallax wheel, said at least one wheel marker is coordinated with said reference one of said at least one marker pin.

20. The firearm scope indicia system of claim 15, further comprising:

a mounting base is secured to the elevation turret of the scope, said marker turret is removably attachable to said mounting base.

* * * * *